United States Patent [19]

Hentschel et al.

[11] Patent Number: 4,770,804

[45] Date of Patent: Sep. 13, 1988

[54] THICKENING SYSTEMS FOR HIGH WATER BASED FUNCTIONAL FLUIDS AND THE HIGH WATER BASED FUNCTIONAL FLUIDS CONTAINING THESE THICKENING SYSTEMS

[75] Inventors: Karl-Heinz Hentschel, Krefeld; Christian Rasp, Bergisch-Gladbach; Siegfried Kussi, Leverkusen; Udo-Winfried Hendricks, Odenthal, all of Fed. Rep. of Germany

[73] Assignee: Bayer Aktiengesellschaft, Leverkusen, Fed. Rep. of Germany

[21] Appl. No.: 900,064

[22] Filed: Aug. 25, 1986

[30] Foreign Application Priority Data

Sep. 7, 1985 [DE] Fed. Rep. of Germany ..... 3531915

[51] Int. Cl.[4] ..... C10M 173/02

[52] U.S. Cl. ..... 252/75; 252/77; 252/79; 524/591; 560/132; 560/158

[58] Field of Search ..... 252/75, 77, 79; 524/591; 560/132, 158

[56] References Cited

U.S. PATENT DOCUMENTS

| | | | |
|---|---|---|---|
| 3,813,341 | 5/1974 | Elliott et al. | 252/77 |
| 4,180,491 | 12/1979 | Kim et al. | 524/500 |
| 4,257,902 | 3/1981 | Singer | 252/75 |
| 4,288,639 | 9/1981 | Camp | 568/625 |
| 4,310,436 | 1/1982 | Camp | 252/316 |
| 4,312,768 | 1/1982 | Nassry et al. | 252/32.7 E |
| 4,312,775 | 1/1982 | Panek et al. | 252/316 |
| 4,354,956 | 10/1986 | Camp | 252/316 |
| 4,390,439 | 6/1983 | Schwartz et al. | 252/73 |
| 4,390,440 | 6/1983 | Schwartz et al. | 252/77 |
| 4,395,351 | 7/1983 | Camp | 252/315.1 |
| 4,411,819 | 10/1983 | Panek et al. | 252/73 |
| 4,481,125 | 11/1984 | Holgado | 252/75 |
| 4,481,367 | 11/1984 | Knopf | 560/26 |
| 4,499,233 | 2/1985 | Tetenbaum et al. | 528/904 |
| 4,521,326 | 6/1985 | Seibert et al. | 252/174.21 |
| 4,636,326 | 1/1987 | Hernandez et al. | 252/79 |

FOREIGN PATENT DOCUMENTS

| | | |
|---|---|---|
| 061822 | 10/1982 | European Pat. Off. . |
| 0122528 | 10/1984 | European Pat. Off. . |
| 063854 | 5/1985 | European Pat. Off. . |
| 061823 | 6/1985 | European Pat. Off. . |
| 41300 | 7/1981 | Japan . |
| 1163041 | 2/1984 | Canada . |
| 00361 | 2/1984 | PCT Int'l Appl. . |
| 1069735 | 5/1967 | United Kingdom . |

*Primary Examiner*—Robert Wax

*Attorney, Agent, or Firm*—Sprung Horn Kramer & Woods

[57] ABSTRACT

The invention relates to the use of combinations of water-soluble polymeric polyether polyols, in which at least 50% of the terminal hydroxyl groups are blocked by reaction with a monoisocyanate incorporating a long-chain aliphatic hydrocarbon radical, and certain surfactants as thickener systems for high water based functional fluids and to the thickened high water based functional fluids.

10 Claims, No Drawings

THICKENING SYSTEMS FOR HIGH WATER BASED FUNCTIONAL FLUIDS AND THE HIGH WATER BASED FUNCTIONAL FLUIDS CONTAINING THESE THICKENING SYSTEMS

BACKGROUND OF THE INVENTION

1. Field of the invention

The invention relates to the use of combinations of specific polymeric thickening agents and surfactants as thickener systems for high water based functional fluids.

2. Background information

In the context of the present invention, functional fluids are taken to mean hydraulic fluids, metal-working fluids (cooling lubricants) and metal-hardening media. Those functional fluids whose water content is either more than 90% by weight, if no low molecular weight glycols are used concomitantly, or more than 70% by weight, preferably more than 80% by weight, in the case where relatively large proportions of low molecular weight glycols, such as ethylene glycol, diethylene glycol, propylene glycol or dipropylene glycol, are employed besides the water as diluents are designated "high water based" in the context of the present invention.

Efforts have been made for about 25 years to replace the flammable mineral oils and mineral oil products which have been hitherto used as functional fluids by inflammable aqueous fluids. This development has, in the meantime, led to aqueous functional fluids with water contents above 90% by weight (so-called "viscous high water-based fluids"). As thickening agents for the preparation of these high water based functional fluids, water-soluble polymeric polyether(poly)ols or combinations of these polymeric polyether(poly)ols with further auxiliaries have been proposed in particular. Thus, polymeric water-soluble polyether polyols incorporating urethane groups are described for the abovementioned purpose in U.S. Pat. No. 4,481,367, in EP-A No. 1-0 031 777 and JA-A No. 1-41 300/81, and polyether monoalcohols modified with long-chain 1,2-epoxyalkanes are described for the above-mentioned purpose in German Patent Specification No. 3,302,465 and U.S. Pat No. 4,288,639. Combinations of these modified polyether monoalcohols with acidic phosphoric acid esters of non-ionic polyether monoalcohol emulsifiers are known from U.S. Pat. Nos. 4,310,436 and 4,395,351 and combinations of these modified polyether monoalcohols with specific polyether esters, acidic phosphoric acid esters of non-ionic polyether monoalcohol emulsifiers and specific sulphurized metal compounds are described in Canadian Patent Specification No. 1,163,041.

Polymeric water-soluble polyether polyols which are modified with long-chain 1,2-epoxyalkanes and their use as thickening agents for high water based functional fluids are described in EP-A No. 1-61 822, WO-A1-84/00361 and in U.S. Pat. Nos. 4,354,956 and 4,411,819. Combinations of these modified water-soluble polymeric polyether polyols with further auxiliaries are known from numerous patent specifications. Thus, for example, combinations of these modified polyether polyols with acidic phosphoric acid esters of non-ionic polyether monoalcohol emulsifiers are described in EP-B No. 1-63 854, with ethoxylated sorbitol monostearates in EP-B No. 1-61 823, with neocarboxylic acids in U.S. Pat. No. 4,390,439 or longer-chain fatty acids in U.S. Pat. No. 4,390,440, with non-ionic surfactants of certain structural classes in EP-A No. 2-122 528, with specific amines and acidic phosphoric acid esters of non-ionic polyether monoalcohol emulsifiers in U.S. Pat No. 4,312,775, with specific polyether esters, defined sulphurized metal compounds and corrosion-inhibitors in U.S. Pat. No 4,312,768 and with lubricity modifiers, dispersing agents and certain high-pressure additives in U.S. Pat. No. 4,481,125.

These known polymeric water-soluble polyether polyols, employed as thickening agents or thickener systems for high water based functional fluids, and combinations thereof with further auxiliaries have, however, the disadvantage that the functional fluids which have been thickened with them are not resistant to shearing, but instead their viscosity is changed under the influence of shearing forces (for example pressure). Resistance to shearing is, however, one of the most important properties of functional fluids. For hydraulic fluids in particular, a viscosity which is independent of shearing forces is absolutely necessary.

SUMMARY OF THE INVENTION

Surprisingly, it has now been found that high water based functional fluids with excellent resistance to shearing are obtained when combinations of water-soluble polymeric polyether polyols, in which at least 50% of the terminal hydroxyl groups are blocked by reaction with a monoisocyanate incorporating a long-chain aliphatic hydrocarbon radical, and certain surfactants are used as a thickener system.

The invention therefore relates to the use of combinations of water-soluble polymeric polyether polyols, in which at least 50% of the terminal hydroxyl groups are blocked by reaction with a monoisocyanate incorporating a long-chain aliphatic hydrocarbon radical, and certain surfactants as thickener systems for high water based functional fluids.

The invention further relates to high water based functional fluids containing, apart from water, combinations of water-soluble polymeric polyether polyols, in which at least 50% of the terminal hydroxyl groups are blocked by reaction with a monoisocyanate incorporating a long-chain aliphatic hydrocarbon radical, and certain surfactants and, if appropriate, additives conventionally used in functional fluids.

DETAILED DESCRIPTION OF THE INVENTION

With the aid of the combinations to be used according to the invention, high water based functional fluids are obtained which are distinguished not only overall by outstanding stability, but also by excellent resistance to shearing. In addition, the blocked water-soluble polymeric polyether polyols used in the thickener systems according to the invention have the advantage that they are significantly easier to prepare than the water-soluble polymeric polyether polyols which are modified by longchain 1,2-epoxyalkanes.

In the combinations, to be used according to the invention as thickener systems, of monoisocyanate-blocked water-soluble polymeric polyether polyols and certain surfactants, the surfactants are included in such an amount that 0.1 to 3 parts by weight, preferably 0.25 to 2.5 parts by weight, of surfactant are present per part by weight of blocked polyether polyol.

Non-ionic and anionic surfactants are used as specific surfactants. Non-ionic or anionic surfactants with low foaming tendency are preferred. Both individual surfactants and mixtures of different surfactants can be employed.

The anionic and non-ionic surfactants usable in the combinations to be used according to the invention are described, for example, in the review "Tenside" by K. Kosswig in Ullmann's Enzyklopadie der techn. Chemie, 4th edition, volume 22, pages 468–494 and 498.

Suitable anionic surfactants are carboxylates, for example, carboxymethylated oxyethylates and derivatives of amino acids; sulphonates, for example, alkylbenzene sulphonates, alkylnaphthalene sulphonates, alkane sulphonates, α-olefin sulphonates, α-sulpho fatty acid esters, sulphosuccinic acid esters, alkoxy-, acyloxy- and acylaminoalkane sulphonates; as sulphates, for example, alkyl sulphates and ether sulphates, phosphonates and phosphates. Alkane sulphonates having 8 to 30 carbon atoms, sulphosuccinic acid esters of $C_{12-18}$-fatty alcohols which have been ethoxylated with 8 to 30 moles of ethylene oxide, of $C_8$–$C_{20}$-alkylphenols which have been reacted with 8 to 70 moles of ethylene oxide, of $C_{12}$–$C_{18}$-fatty acids or $C_{12}$–$C_{18}$-fatty alcohols which have been ethoxylated with 8 to 30 moles of ethylene oxide; $C_{12}$–$C_{18}$-n-alkyl sulphates; and sulphates of $C_{12}$–$C_{18}$-fatty alcohols, $C_{12}$–$C_{18}$-fatty acids and $C_8$–$C_{20}$-alkylphenols which have been ethoxylated with 8 to 30 moles of ethylene oxide are preferred.

Suitable non-ionic surfactants are oxyethylates terminally blocked oxyethylates and fatty acid esters of polyhydroxy compounds, and also block polymers of propylene oxide and ethylene oxide. $C_{12}$–$C_{18}$-fatty acids which have been reacted with 8 to 50 moles of ethylene oxide, $C_{12}$–$C_{18}$-fatty acid amides which have been ethoxylated with 8 to 40 moles of ethylene oxide, $C_{12}$–$C_{18}$-fatty alcohols which have been ethoxylated with 8 to 30 moles of ethylene oxide, $C_8$–$C_{20}$-alkylphenols which have been ethoxylated with 8 to 50 moles of ethylene oxide and styrenated or benzylated phenols which have been ethoxylated with 8 to 60 moles of ethylene oxide, are preferably used as non-ionic surfactants. Non-ionic surfactants with a hydrophiliclipophilic balance of $<18$ are used preferably.

The monoisocyanate-blocked water-soluble polymeric polyether polyols to be employed in the combinations to be used according to the invention are reaction products of polymeric water-soluble polyether polyols, known per se, which have an average molecular weight of 5,000 to 70,000 (established by determination of the terminal OH groups);the average molecular weight is calculated from the number of terminal OH groups using the following formula:

$$MW = \frac{56100 \times f}{OH \text{ Number}} \quad (f = \text{functionality of the polyether polyol})$$

with a monoisocyanate incorporating a long-chain aliphatic hydrocarbon radical.

Suitable long-chain aliphatic hydrocarbon radicals are, in particular, $C_{12}$–$C_{30}$-alkyl radicals such as the dodecyl, hexadecyl, octadecyl and the behenyl radical and $C_{12}$–$C_{30}$-alkenyl radicals such as the oleyl radical. These long-chain aliphatic hydrocarbon radicals do not necessarily have to be bonded directly to the isocyanate group, but can instead be bonded to the isocyanate group via other groups, for example aromatic rings and/or urethane groups. Such monoisocyanates, in which the long-chain aliphatic hydrocarbon radicals are not bonded directly to the isocyanate group, are, for example, the addition products of 1 mole of a $C_{12}$–$C_{30}$-n-alkanol, for example, lauryl, myristyl, cetyl, stearyl or behenyl alcohol, or of oleyl alcohol and 1 mole of an aliphatic, cycloaliphatic, aromatic or hetero-cyclic diisocyanate.

For the preparation of the water-soluble polymeric polyether polyols which are blocked with the monoisocyanates, the amount of monoisocyanate is adjusted so that at least 50%, preferably 70 to 100%, of the terminal hydroxyl groups present in the polymeric polyether polyols which are soluble in water are blocked.

The blocking of the terminal OH groups of the polymeric water-soluble polyether polyols with the monoisocyanates incorporating a long-chain hydrocarbon radical is, in principle, a known reaction (cf., for example, Ullmann's Enzyklopadie der techn. Chemie, 4th edition, volume 19, pages 309–310). The end of the reaction can be determined IR spectroscopically on the basis of the disappearance of the absorption band at about 2,270 $cm^{-1}$, which are typical for isocyanates. This addition reaction can be accelerated in a known fashion by the concomitant use of known catalysts.

The water-soluble blocked polymeric polyether polyols, if appropriate, incorporating urethane or ester groups, with average molecular weights of 5,000 to 70,000 on which the blocked water-soluble polyether polyols are based are known or can be obtained by processes which are known per se, for example by polymerization of ethylene oxide or copolymerization of ethylene oxide with other alkylene oxides in the presence of compounds possessing at least two active hydrogen atoms, and, if appropriate, modification of the water-soluble polymeric polyether polyols thus obtained by reaction with diisocyanates or dicarboxylic acids to produce water-soluble polymeric polyether polyols which incorporate urethane or ester groups, or by polymerization of ethylene oxide or copolymerization of ethylene oxide and other alkylene oxides in the presence of compounds which possess two active hydrogen atoms and reaction of the water-soluble polyether diols obtained with polyisocyanates, maintaining an isocyanate group/OH group ratio of at most 0.5:1, to give water-soluble polymeric polyether polyols incorporating urethane groups.

The combinations of monoisocyanate-blocked water-soluble polymeric polyether polyols and surfactants, to be used according to the invention, are prepared by mixing both components with one another in the liquid state to produce a homogeneous fluid. Since they are in many cases solid at room temperature, the components are, in general, heated to the melting temperature, that is to say temperatures of 60° to 100° C., and stirred at this temperature until a homogeneous fluid is produced. When using surfactant mixtures, it can be advantageous to mix only one surfactant with the blocked polyether polyol in the liquid state initially and subsequently to stir the second or the remaining surfactants into the homogeneous melt.

The combinations of blocked water-soluble polymeric polyether polyols and surfactants thus obtained are, to make them easier to handle during the preparation of the functional fluids, diluted by addition of water to give fluid concentrates with a water content of about 30 to 70% by weight, preferably 40 to 60% by weight, relative to the weight of the concentrate.

The ready-for-use hydraulic fluids, metal-working fluids (cooling lubricants) and metal-hardening media are prepared from these concentrates by further dilution with water.

In addition to water and the thickener system, the concentrates, or the functional fluids prepared from them by dilution, can also contain additives which are conventionally used in these functional fluids, such as lubricity improvers, metal deactivators, corrosion inhibitors, anti-foam agents, substances to adjust or buffer certain pH values, anti-ageing agents, biocides, identification dyestuffs, etc., in amounts usual for these additives, and monomeric and/or oligomeric glycols.

The high water based functional fluids, thickened according to the invention, preferably contain, in addition to water and, if appropriate, monomeric and/or oligomeric glycols, 3 to 7% by weight of the combination to be used according to the invention as a thickener system and, if appropriate, additionally 0.5 to 3, preferably 1 to 3, % by weight of the abovementioned additives conventionally used in functional fluids, and, if appropriate, up to 25% by weight, for example 0.5 to 20% by weight, of monomeric and/or oligomeric glycols.

EXAMPLES

Description of the surfactants (I) used in the examples, the water-soluble polymeric polyether polyols (II) blocked with monoisocyanates and the water-soluble polyether polyols (III) used for the preparation of these blocked polyether polyols.

Surfactants

Surfactant A: Oleyl alcohol ethoxylated with 19 moles of ethylene oxide

Surfactant B: Bis-(1-phenylethyl)-phenol ethoxylated with 50 moles of ethylene oxide Surfactant C: 3-Benzyl-4-hydroxybiphenyl ethoxylated with 14 moles of ethylene oxide Surfactant D: Oleyl alcohol ethoxylated with 12 moles of ethylene oxide Surfactant E: N,N-Bis-(2-hydroxyethyl)-oleylamine Surfactant F: Trisodium salt of the phosphonosuccinate ester of p-nonylphenol, ethoxylated with 30 moles of ethylene oxide Surfactant G: Disodium salt of the sulphosuccinate ester of p-nonylphenol ethoxylated with 30 moles of ethylene oxide Surfactant H: Sodium salt of $C_{14}$–$C_{18}$-n-alkyl sulphonate Surfactant I: Sodium salt of an arylalkyl sulphonate with 50% mono- and 50% disulphonate proportion mix Surfactant J: Coconut acid diethanolamide Surfactant K: Acidic phosphate, obtained by reaction of 1 mole of phosphorus pentoxide with 4 moles of octadecan-1-ol and 2 moles of octadecyl-1-decaethoxylate, subsequently neutralized with diethanolamine Surfactant L: Oleyl alcohol ethoxylated with 50 moles of ethylene oxide

II. Monoisocyanate-blocked water-soluble polymeric polyether polyols

Blocked polyether polyol I

A mixture of 1346.4 g of polyether polyol A (0.06 mol), 0.15 g of 1,4-diazabicyclo-2,2,2-octane (DABCO) and 500 g of dry dioxane are refluxed with stirring. 50.6 g of dodecyl isocyanate (0.24 mol) are added dropwise over one hour. The reaction mixture is subsequently stirred and refluxed until an isocyanate band is no longer detectable in the infra-red spectrum of a sample of the reaction mixture. After the dioxane is distilled off at about 130° C./15 hPa, a reaction product remains which is viscous at elevated temperatures and solidifies at low temperatures. Degree of blocking of the terminal hydroxyl groups in the reaction product: 100%.

Blocked polyether polyol 2

1346.4 g of polyether polyol A (0.06 mol) are reacted with 64.1 g of hexadecyl isocyanate (0.24 mol) in the way described in Example 1.

Degree of blocking of the terminal hydroxyl groups in the reaction product: 100%.

Blocked polyether polyol 3

897.6 g of polyether polyol A (0.04 mol) are reacted with 87.7 g (0.16 mol) of a behenyl alcohol/isophorone diisocyanate (IPDI) (1:1) adduct in 500 g of dry dioxane until the isocyanate band has disappeared in the IR spectrum. The reaction mixture is worked up as described in Example 1. Degree of blocking of the terminal hydroxyl groups in the reaction product: 100%.

Blocked polyether polyol 4

897.6 g of polyether polyol A (0.04 mol) are reacted with 45.8 g (0.155 mol) of stearyl isocyanate as described in Example 3. Degree of blocking of the terminal hydroxyl groups in the reaction product: 97%.

Blocked polyether polyol 5

1240 g of polyether polyol B (0.08 mol) are reacted with 94.4 g (0.32 mol) of stearyl isocyanate as described in Example 3 (using 500 g of dried dioxane). Degree of blocking of the terminal hydroxyl groups in the reaction product: 100%.

Blocked polyether polyol 6

775 g of polyether polyol B (0.05 mol) are reacted with 29.5 g of stearyl isocyanate (0.1 mol) as described in Example 3 (using 500 g of absolute dioxane). Degree of blocking of the terminal hydroxyl groups in the reaction product: 50%.

Blocked polyether polyol 7

775 g of polyether polyol B (0.05 mol) are reacted with 44.3 g of stearyl isocyanate (0.15 mol) under the conditions described in Example 3. Degree of blocking of the terminal hydroxyl groups in the reaction product: 75%.

Blocked polyether polyol 8

1346.4 g of polyether polyol A (0.06 mol) are initially reacted with 5.2 g of 2,4-toluylene diisocyanate (TDI) (0.03 mol) in 500 g of anhydrous dioxane in the presence of 0.12 g of DABCO by refluxing and stirring for one hour (average molecular weight of the urethane group-containing polyether polyol thus obtained: 45,000). The reaction mixture is subsequently mixed with 53.1 g of stearyl isocyanate (0.18 mol) within 1 hour, still refluxing and stirring, and subsequently further heated with stirring until the isocyanate band in the IR spectrum has disappeared. The reaction mixture is worked up as described in Example 3. Degree of blocking of the terminal hydroxyl groups in the reaction product: 100%.

Blocked polyether polyol 9

897.6 g of polyol A (0.04 mol) are reacted with 4.5 g of IPDI (0.02 mol) and 33.6 g of stearyl isocyanate (0.114 mol) under the reaction conditions described in Example 3 (using 500 g of anhydrous dioxane). Average molecular weight of the urethane group-containing polyether polyol on which the blocked polyether polyol is based: 45,000. Degree of blocking of the terminal hydroxyl groups in the reaction product: 95%.

Blocked polyether polyol 10

1240 g of polyol B (0.08 mol) are reacted with 8.9 g of IPDI (0.04 mol) and 70.8 g of stearyl isocyanate (0.24 mol) under the conditions described in Example 3 (using 500 g of anhydrous dioxane). Average molecular weight of the urethane group-containing polyether polyol on which the blocked polyether polyol is based: 31,200 . Degree of blocking of the terminal hydroxyl groups in the reaction product: 100%.

Blocked polyether polyol 11

1300 g of polyether polyol C (0.234 mol) are melted at 90° to 100° C. and mixed with 73 mg of iron acetyl acetonate, dissolved in 2 ml of toluene. 54.5 g of stearyl isocyanate (0.185 mol) and 24.4 g of a mixture of 65% by weight of 2,4-toluylene diisocyanate and 35% by weight of 2,6-toluylene diisocyanate (0.14 mol) are simultaneously added dropwise to the mixture at 125° to 130° C. Average molecular weight of the urethane group-containing polyether polyol on which the blocked polyether polyol is based: 14,000 . The reaction is ended after a reaction time of 2 hours. Degree of blocking of the terminal hydroxyl groups in the reaction product: 100%.

Blocked polyether polyol 12

(not according to the invention, comparison compound)

A mixture of 1346.4 g of polyether polyol A (0.06 mol) and 500 g of anhydrous dioxane are refluxed (about 110° C.) with stirring in the presence of 0.15 g of DABCO. 30.0 g of cyclohexyl isocyanate (0.24 mol) are then added dropwise within 1 hour and the reaction mixture is stirred and refluxed until an isocyanate band is no longer detectable in the infrared spectrum of a sample. The reaction mixture is worked up as described in Example 1.

Degree of blocking of the terminal hydroxyl groups in the reaction product: 100%.

Blocked polyether polyol 13

(not according to the invention, comparison polyether polyol)

1346.4 g of polyether polyol A (0.06 mol) are reacted with 36.2 g of norborn-2-yl-methyl isocyanate (0.24 mol) under the reaction conditions described under polyether polyol 12. Degree of blocking of the terminal hydroxyl groups in the reaction product: 100%.

III. Water-soluble polymeric polyether polyols used for the preparation of the blocked polyether polyols 1 to 13

Polyether polyol A

Reaction product of pentaerythritol, ethylene oxide and propylene oxide. The polyether chain contains 25% by weight of propylene oxide units and 75% by weight of ethylene oxide units distributed at random. Average molecular weight: 22,400.

Polether polyol B

Reaction product of pentaerythritol, ethylene oxide and propylene oxide. The polyether chain contains 25% by weight of propylene oxide units and 75% by weight of ethylene oxide units distributed at random. Average molecular weight: 15,500.

Polyether polyol C

Polyethylene glycol with an average molecular weight of 5555.

General description of the examples compiled in the table below

Preparation of the combinations of monoisocyanate-blocked water-soluble polymeric polyether polyol and surfactant to be used according to the invention as a thickener system:

(a) When one surfactant is used:

The parts by weight of blocked polyether polyol and surfactant specified in the table below are liquefied by warming to about 90° C. and stirred to produce a homogeneous fluid. This is subsequently diluted by addition of water to give a concentrate containing 50% by weight of water.

(b) When two or more surfactants are used:

In this case, the amount of blocked polyether polyol specified in the table is initially liquefied by warming to about 90° C. with only one of the surfactants to be used in the amount specified in the table for this surfactant, and then stirred to give a homogeneous fluid. The other surfactant or surfactants, in the amount specified in the table for this or these surfactants, is subsequently also stirred into this fluid, still at elevated temperature until, again, a homogeneous fluid is produced. This, too, is diluted by addition of water to give a concentrate containing 50% by weight of water.

The concentrates obtained according to (a) or (b) are diluted to 100 parts by weight of solution by addition of further water with stirring. In a particularly characterized case, the concentrates are diluted to 100 parts by weight of solution with a mixture of 80% by weight of water, 10% by weight of diethylene glycol and 10% by weight of dipropylene glycol. The viscosities at 40° and 50° C. and the change in viscosity under the influence of shear forces (according to DIN 51,382; modification: 300 cycles instead of 30 cycles) are determined for the thickened aqueous solutions (functional fluids) thus obtained, whose water content is 91 to 95.5% by weight, depending on the amount of thickener system used. The values obtained and the viscosity ratio calculated from the viscosities at 40° and 50° C. are compiled in the table below. In addition, the factor by which the viscosity of water thickened according to the invention is higher than the viscosity of water thickened only with the blocked polyether polyol is specified in the table in the column "thickening factor by addition of surfactant" (the synergistic action of the surfactant in the combinations according to the invention follows from this thickening factor).

TABLE

| Example | Blocked polyether polyol No. | Parts by weight | Surfactant | Parts by weight | Viscosity 40° C. | $\frac{mm^2}{s}$ 50° C. | Viscosity ratio 40° C./50° C. | Thickening factor of surfactant at 40° C. | at 50° C. | Change in viscosity [%] under the influence of shear forces |
|---|---|---|---|---|---|---|---|---|---|---|
| 1 (a) | 1 | 5 | A | 2 | 70.7 | 35.5 | 2.0 | 3.5 | 3.7 | 4 |
| (b) | 1 | 5 | B | 2 | 42.1 | 21.0 | 2 | 2.1 | 2.2 | (10) |
| (c) | 1 | 5 | A + B | 2 + 2 | 79.5 | 41.3 | 1.9 | 4 | 4.3 | (10) |
| (d) | 1 | 5 | C | 2 | 45.2 | 22.2 | 2 | 2.2 | 2.3 | (10) |
| (e) | 1 | 5 | — | 2 | 20.1 | 9.5 | 2.1 | — | — | — |
| 2 (a) | 2 | 5 | — | | 26.9 | 8.8 | 3.05 | — | — | — |
| (b) | 2 | 5 | A | 2 | 30.4 | 90.5 | 3.35 | 11.3 | 10.3 | (10) |
| 3 (a) | 3 | 5 | — | | 3.4 | 2.3 | 1.5 | — | — | — |
| (b) | 3 | 5 | A | 2 | 5.4 | 3.6 | 1.5 | 1.6 | 1.6 | (10) |
| 4 (a) | 4 | 5 | — | | 10 | 3.7 | 2.7 | — | — | — |
| (b) | 4 | 5 | A | 2 | 212 | 52 | 4.1 | 21.2 | 14 | (10) |
| (c) | 4 | 5 | D | 2 | 252 | 61.5 | 4.1 | 25.1 | 16.6 | (10) |
| 5 (a) | 5 | 5 | — | | 14.3 | 6.8 | 2.1 | — | — | — |
| (b) | 5 | 5 | A | 2 | 1258 | 287 | 4.4 | 88 | 42 | (10) |
| 6 (a) | 6 | 5 | — | | 3.17 | n.m. | | — | | — |
| (b) | 6 | 5 | A | 2 | 13.5 | n.m. | | 4.2 | | — |
| 7 (a) | 7 | 5 | — | | 3.8 | n.m. | | — | | — |
| (b) | 7 | 5 | A | 2 | 37.6 | 8.9 | 3.1 | 7.2 | | (10) |
| 8 (a) | 8 | 5 | — | | 866 | 161 | 5.4 | | | (10) |
| (b) | 8 | 5 | A | 2 | 6611 | 1829 | 3.6 | 7.6 | 11.4 | (10) |
| 9 (a) | 9 | 3 | — | | 4.0 | 2.26 | 1.75 | — | | — |
| (b) | 9 | 3 | A | 2 | 92.9 | 22.8 | 4.1 | 23 | 10 | (10) |
| (c) | 9 | 4 | — | | 15.0 | 5.6 | 2.7 | — | | — |
| (d) | 9 | 4 | A | 2 | 506 | 121 | 4.2 | 34 | 22 | (10) |
| (e) | 9 | 5 | | | 84.7 | 19.6 | 4.3 | — | | (10) |
| (f) | 9 | 5 | A | 2 | 1417 | 365 | 3.9 | 16.7 | 18.6 | (10) |
| (g) | 9 | 4 | A | 1 | 242 | 52.1 | 4.6 | 16 | 9.3 | (10) |
| (h) | 9 | 4 | A | 2 | 506 | 121 | 4.2 | 34 | 22 | (10) |
| (i) | 9 | 4 | A | 3 | 644 | 173 | 3.7 | 43 | 31 | (10) |
| (j) | 9 | 4 | A | 4 | 493 | 140 | 3.5 | 33 | 25 | (10) |
| (k) | 9 | 4 | A | 5 | 396 | 122 | 3.2 | 26 | 22 | (10) |
| 9 (l) | 9 | 4 | B | 2 | 307 | 74 | 4.1 | 20 | 13 | (10) |
| (m) | 9 | 4 | A + B | 2 + 2 | 470 | 127 | 3.7 | 31.5 | 22.7 | (10) |
| (n) | 9 | 5 | E | 2 | 1075 | 301 | 3.6 | 13 | 15 | (10) |
| (o) | 9 | 5 | F | 2 | 885 | 230 | 3.8 | 10.5 | 12 | (10) |
| (p) | 9 | 5 | G | 2 | 883 | 230 | 3.8 | 10.5 | 12 | (10) |
| (q) | 9 | 5 | D | 2 | 1518 | 363.3 | 4.2 | 18 | 18.5 | (10) |
| (r) | 9 | 5 | H | 2 | 403.5 | 111.7 | 3.6 | 4.75 | 5.7 | (10) |
| (s) | 9 | 5 | I | 2 | 415 | 48.6 | 8.5 | 5 | 2.5 | (10) |
| (t) | 9 | 4 | J | 2 | 304 | 24 | 12.7 | 20 | 4.3 | (10) |
| (u) | 9 | 4 | K | 1 | 182.5 | 37 | 4.9 | 12.2 | 6.6 | (10) |
| (v) | 9 | 4 | L | 3 | 5070 | 1310 | 3.9 | 338 | 233 | 4 |
| (w)* | 9 | 4 | — | — | 27.7 | 12 | 2.3 | — | — | <10 |
| (x)* | — | 4 | L | 3 | 144 | 55 | 2.6 | 5.2 | 4.6 | — |
| 10 (a) | 10 | 2.5 | — | | 8.6 | 4.1 | 2.1 | | | — |
| (b) | 10 | 2.5 | A | 1 | 755 | 155 | 4.9 | 88 | 28 | (10) |
| 11 (a) | 11 | 1.25 | — | — | 9.2 | 2.9 | 3.2 | — | — | (10) |
| (b) | 11 | 1.25 | A + B | 2 + 1 25 | 108.1 | 41.7 | 2.6 | 11.7 | 14.4 | (10) |
| 12 (a) | 12 | 5 | — | — | 2.1 | n.m. | — | — | — | — |
| (b) | 12 | 5 | A | 2 | 2.4 | n.m. | — | 1.15 | | — |
| 13 (a) | 13 | 5 | — | | 2.1 | 1.7 | 1.25 | — | — | — |
| (b) | 13 | 5 | A | 2 | 2.5 | 1.9 | 1.3 | 1.2 | 1.1 | 10 |

*Total solution contains 8.6% by weight of diethylene glycol and 8.6% by weight of dipropylene glycol It will be appreciated that the instant specification and claims are set forth by way of illustration and not limitation, and that various modifications and changes may be made without departing from the spirit and scope of the present invention.

What is claimed is:

1. In a high water content functional fluid for use as a hydraulic fluid, metal-working fluid or metal-hardening media, the functional fluid comprising (a) water, (b) a thickener and (c) at least one functional additive and/or a glycol, wherein the improvement comprises the thickener consisting essentially of (1) a water-soluble polymeric polyether polyol, wherein said polyol is polyethylene glycol, in which at least 50% of the terminal hydroxyl groups are blocked by a reaction with a monoisocyanate incorporating a long-chain aliphatic hydrocarbon radical selected from the group consisting of (i) $C_{12}$- to $C_{30}$-alkyl radicals, (ii) $C_{12}$- to $C_{30}$-alkenyl radicals and (iii) addition products of equimolar molar amounts of (A) a $C_{12}$- to $C_{30}$-n-alkanol and (B) of an aliphatic, cycloaliphatic, aromatic or heterocyclic diisocynate and (2) an anionic surfactant or a nonionic surfactant or a mixture of nonionic surfactants.

2. A high water content functional fluid according to claim 1, which further comprises one or more additives selected from the group consisting of lubricity improves, metal deactivators, corrosion inhibitors, anti-foam agents, anti-ageing agents, biocides, dyestuffs and pH modifiers.

3. A high water content functional fluid according to claim 1, wherein 0.1 to 3 parts by weight of surfactant are present in the combinations per part by weight of blocked polyether polyol.

4. A high water content functional fluid according to claim 2, wherein the additive is contained in an amount of 0.5 to 3% by weight.

5. A high water content functional fluid according to claim 1, wherein 0.25 to 2.5 parts by weight of surfactant are present per part by weight of blocked polyether polyol.

6. A high water content functional fluid according to claim 1, wherein the surfactant is selected from the group consisting of carboxylates, sulphonates, sulphates, oxyethylates, terminally blocked oxyethylates, fatty acid esters of polyhydroxy compounds, block polymers of propylene oxide and block polymers of ethylene oxide.

7. A high water content functional fluid according to claim 1, wherein 70% to 100% of the terminal hydroxyl groups are blocked.

8. A high water content functional fluid according to claim 1, further comprising up to 25% by weight of glycols.

9. A high water content functional fluid according to claim 2, wherein one or more additives is contained in an amount of 0.5 to 3% by weight.

10. A high water content functional fluid according to claim 1, wherein the $C_{12}$–$C_{30}$-n-alkanol is selected from the group consisting of lauryl alcohol, myristyl alcohol, cetyl alcohol, stearyl alcohol, behenyl alcohol and oleyl alcohol.

* * * * *